US005237245A

United States Patent [19]

Kemner et al.

[11] Patent Number: 5,237,245

[45] Date of Patent: Aug. 17, 1993

[54] TELEVISION PICK-UP TUBE AND DEFLECTION SYSTEM FOR USE IN SUCH A TELEVISION PICK-UP TUBE

[75] Inventors: Rudolf Kemner; Pieter Zuidhof, both of Eindhoven, Netherlands

[73] Assignee: U.S. Philips Corporation, New York, N.Y.

[21] Appl. No.: 699,853

[22] Filed: May 14, 1991

[30] Foreign Application Priority Data

May 21, 1990 [NL] Netherlands ..... 9001171

[51] Int. Cl.[5] ..... H01J 29/56

[52] U.S. Cl. ..... 315/370; 315/399; 335/213

[58] Field of Search ..... 315/399, 370; 335/213; 313/421, 427, 431, 440; 250/213 VT

[56] References Cited

U.S. PATENT DOCUMENTS 3,587,019 6/1971 Bull et al. ..... 335/213

4,298,894 11/1981 Takamura et al. ..... 313/440

*Primary Examiner*—Theodore M. Blum

*Attorney, Agent, or Firm*—Robert J. Kraus

[57] ABSTRACT

Accumulation of charge between neighboring image lines can be prevented in a television pick-up tube in which an image pick-up face is scanned along image lines by an electron beam when a comparatively small periodic deflection is imposed on the electron beam in a direction perpendicular to the image lines. To achieve this, a magnetic deflection element in the form of a saddle-shaped coil is disposed between the vertical deflection element of the television pick-up tube and the envelope of the electron gun.

9 Claims, 3 Drawing Sheets

TELEVISION PICK-UP TUBE AND DEFLECTION SYSTEM FOR USE IN SUCH A TELEVISION PICK-UP TUBE

BACKGROUND OF THE INVENTION

The invention relates to a television pick-up tube, comprising an electron source for emitting an electron beam to an image pick-up face, a horizontal deflection device for deflecting the electron beam across the image pick-up face along an image line, a vertical deflection device for deflecting the electron beam in a direction transversely of the image line, and a magnetic deflection element for periodic deflection of the electron beam between transverse positions situated to both sides of the image line during deflection of the electron beam along the image line.

The invention also relates to a deflection system for use in such a television pick-up tube.

A television pick-up tube of this kind is known from U.S. Pat. No. 4,710,799.

The cited Patent Specification describes a television pick-up and reproduction system in which the television pick-up tube and the television monitor are provided with a further magnetic or electrostatic deflection element whereby the electron beams can be deflected so that they traverse an undulating path around the image lines across the image pick-up face of the television pick-up tube and the image display face of the television monitor. The vertical resolution is thus enhanced.

When use is made of a television pick-up tube whose image pick-up face is large in comparison with the beam diameter, for example as in medical imaging systems, the image pick-up face being scanned in a comparatively small number of image lines (625 instead of 1250) in the case of low-resolution imaging, charge is liable to remain between the image lines, which charge is not compensated for by the electron beam. A positive charge accumulation attracts the electron beam in an undesirable manner so that an annoying local flicker effect occurs in the television image. This effect can be counteracted by deflecting the electron beam along a path undulating around the image lines.

SUMMARY OF THE INVENTION

It is inter alia an object of the invention to provide a television pick-up tube of the kind set forth which is provided with a further magnetic deflection element for generating a uniform magnetic field of comparatively high frequency with respect to the field generated by the horizontal deflection device, the further magnetic deflection element having a minimum effect on the horizontal and the vertical deflection in the non-activated state.

To achieve this, a television pick-up tube in accordance with the invention is characterized in that the magnetic deflection element comprises a saddle-shaped coil having a current-conductive strip which is disposed on a cylindrical surface.

Because of the use of a saddle-shaped coil of the described kind, a uniform magnetic field can be generated with respect to the image pick-up face so that the electron beam can be deflected at a frequency of, for example 75 MHz. Because the saddle-shaped coil is comparatively thin in a radial direction of the television pick-up tube, a dimension of the television pick-up tube is hardly increased by the use of the saddle-shaped coil, so that the television pick-up tube in accordance with the invention can readily replace known television pick-up tubes.

An embodiment of a television pick-up tube in accordance with the invention is characterized in that the saddle-shaped coil is disposed between the coils and the envelope.

Because of the small thickness of the saddle-shaped coil in accordance with the invention, it can be disposed between the coils of the horizontal deflection device and the vertical deflection device without the distance between the coils and the electron beam being increased to such an extent that the deflection is affected. In known television pick-up tubes there is an adequate space between the coils of the horizontal deflection device and the vertical deflection device on the one side and the envelope on the other side to accommodate the saddle-shaped coil in accordance with the invention, so that existing television pick-up tubes can be simply provided with a saddle-shaped coil.

It is to be noted that from European Patent Application EP 091 765-A1, corresponding to U.S. Pat. No. 4,589,012, it is known to insert a magnetic deflection element in the form of an additional coil between the envelope and the coils of the horizontal deflection device and the vertical deflection device. However, no information is given as regards the shape of the additional coil.

A further embodiment of a television pick-up tube in accordance with the invention is characterized in that, viewed in a radial cross-section of the cylindrical surface, the strip is situated in points on a circle which are situated at an angular distance of substantially 60°, 120°, 240° and 300°, respectively, with respect to a reference radius.

In order to obtain a uniform magnetic field, a H-shaped or U-shaped closed loop can be provided on a cylindrical surface by vapour deposition, for example directly on the envelope of the television pick-up tube, the long side of the loop extending in the axial direction. Per limb of the loop the angular distance between neighbouring long sides on the cylindrical surface amounts to 120°. Suitable homogeneity of the magnetic field is thus achieved.

A further embodiment of a television pick-up tube in accordance with the invention is characterized in that the strip is connected to respective current conductors in two contact points, a common capacitance of the current conductors constituting a resonant circuit in conjunction with a self-inductance of the strip.

As a result of the use of current conductors having a capacitance adapted to the frequency range of the further deflection device (for example, two strip-shaped conductors situated at a small distance from one another), an additional tuning capacitor can be dispensed with; this is a major advantage because of the limited space between the low-frequency magnetic deflection element and the envelope of the television pick-up tube.

A further embodiment of a television pick-up tube in accordance with the invention is characterized in that the saddle-shaped coil and the coil of the vertical deflection device extend over substantially the same length.

A maximum effect of the saddle-shaped coil on the electron beam occurs when the magnetic fields of the saddle-shaped coil and the coil of the vertical deflection device appear at the same location in the television pick-up tube. This is achieved by positioning both coils along the same length portion of the television pick-up tube.

BRIEF DESCRIPTION OF THE DRAWING

Some embodiments of a television pick-up tube and a deflection system in accordance with the invention will be described in detail hereinafter with reference to the accompanying drawing. Therein.

FIGS. *2a* and *2b* show an electron beam path across an image pick-up face in a television pick-up tube.

DESCRIPTION OF THE PREFERRED EMBODIMENTS

Figure 1:
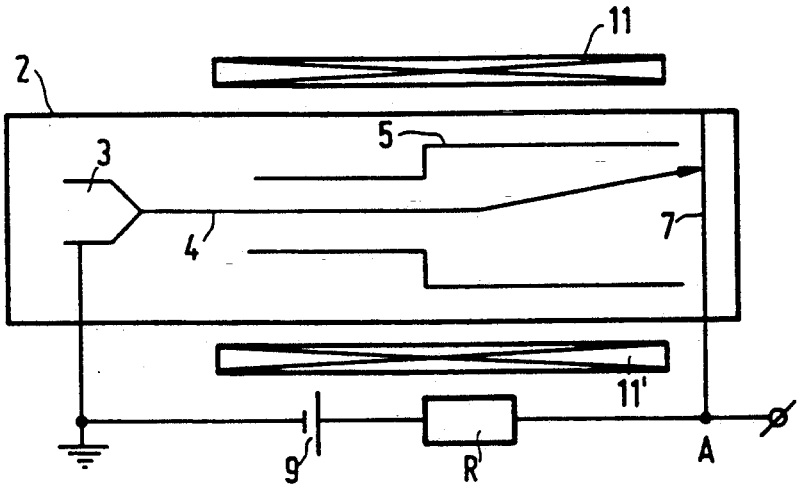
FIG. 1 PRIOR ART
FIG. 1 is a diagrammatic representation of a known television pick-up tube.
Figure 2A:
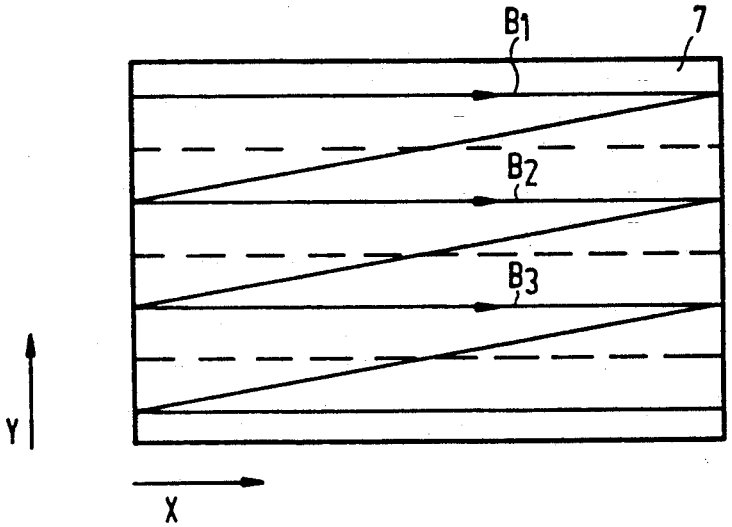
FIG. 2a PRIOR ART
Figure 2B:
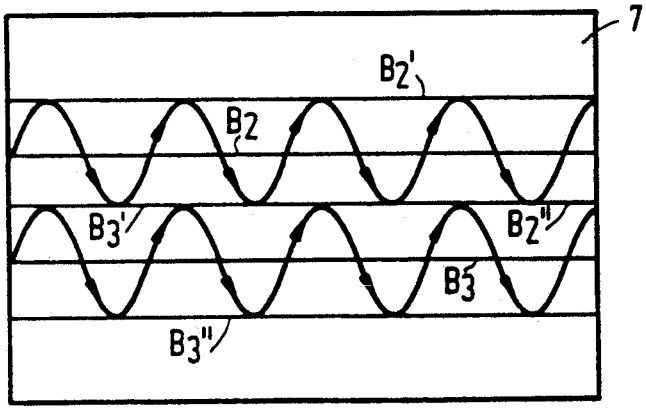
FIG. 2b PRIOR ART

FIG. 1 shows a television pick-up tube comprising, situated within an envelope 2, an electron source 3 and focusing electrodes 5. An electron beam 4 to be emitted by the electron source 3 is imaged on an image pick-up face 7 by means of the focusing electrodes 5. The image pick-up face 7 comprises a layer of photoconductive material, for example PbO, on which a charge pattern is built up in conformity with the local light intensity on the image pick-up face 7. In pixels of the image pick-up face 7 a positive charge is accumulated across an intrinsic capacitance of the photoconductive layer. When the electron beam 4 is incident on a pixel, the pixel is discharged to the cathode potential which amounts to 0 V in the present example. As a result, a voltage drop occurs across the resistance R with respect to the voltage source 9 which has a clamping voltage of, for example 30 V. This voltage drop is extracted at the point A and constitutes the video signal which can be displayed on a monitor. Using a horizontal deflection device 11 and a vertical deflection device 11', formed by coils in the present embodiment but, for example at least one of which is replaceable by an elactrostatic deflection device situated within the envelope 2, the electron beam is deflected across the image pick-up face 7.

FIG. *2a* shows the path traversed by the electron beam 4 across the image pick-up face 7. The electron beam moves along image lines B from a first to a second edge of the image pick-up face 7 under the influence of a magnetic field which is generated by the horizontal deflection device 11. A self-inductance of the horizontal deflection device 11 amounts to, for example 1 mH. After having been moved along an image line B1, the electron beam is displaced in a transverse direction (denoted by the letter Y in the Figure) by means of the vertical deflection device 11', so that the electron beam is situated at the beginning of the image line B2 on the image pick-up face. A self-inductance of the vertical deflection device 11' is, for example between 1 and 30 mH. In the case of an image which is composed of two interlaced frames, represented by the non-interrupted lines and the interrupted lines in the Figure and comprising 312.5 lines each, a deflection frequency in the Y direction amounts to 50 Hz and a deflection frequency in the direction of the image lines (X direction) amounts to $50 \times 312.5 = 15.6$ kHz. The two deflection devices 11 and 11' are coils adapted to those frequencies. When the image lines B are spaced comparatively far apart in comparison with a beam diameter of electron beam 4, being the case in television pick-up tubes for medical applications which have a diameter of 2 inches, a positive charge remains between the image lines. The electron beam is thus undesirably deflected so that annoying brightness fluctuations occur in the television image. This negative effect can be counteracted by deflecting the electron beam 4 along a path across the image pick-up face 7 as shown in FIG. *2b*. In order to achieve such deflection, the television pick-up tube comprises a magnetic high-frequency deflection element so that an additional deflection frequency in the Y direction amounts to, for example 75 MHz. At this frequency, the number of excursions of the electron beam between the transverse positions B' and B'', situated to both sides of an image line B, amounts to 2400.

Figure 3:
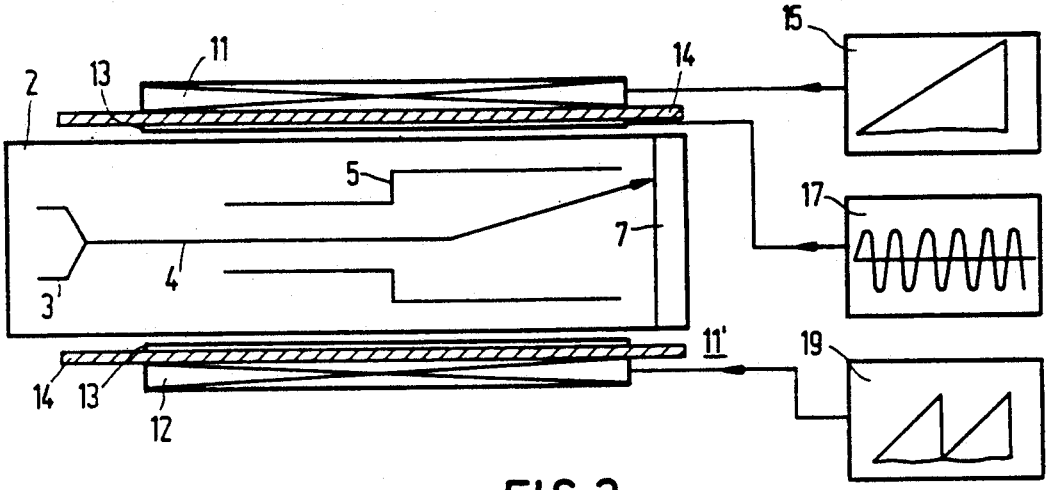
FIG. 3 shows a television pick-up tube provided with a magnetic deflection element in accordance with the invention.

FIG. 3 shows a magnetic deflection element 13 in the form of a saddle-shaped coil which comprises a strip-shaped conductor and which is accommodated between the horizontal deflection device 11 and the vertical deflection device 11' on the one side and the envelope on the other side; it is secured, for example to an inner side of a cylindrical support 14. The deflection element 13 is connected to an oscillator 17 which has a high frequency in comparison with the sawtooth generators 15 and 19 connected to the horizontal deflection device 11 and the vertical deflection device 11'.

Figure 4:
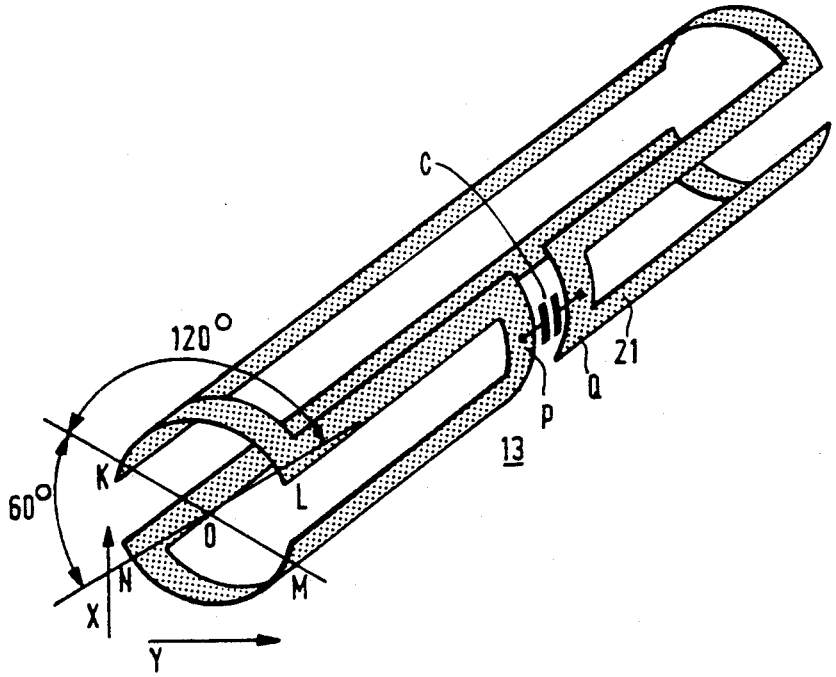
FIG. 4 shows a saddle-shaped coil in accordance with the invention.

A magnetic deflection element 13 of the kind shown in FIG. 4 is very suitable for mounting between the envelope 2 of the television pick-up tube, the horizontal deflection device 11 and the vertical deflection device 11'. The saddle-shaped coil 13 has a self-inductance of, for example 100 nH and comprises a conductive strip 21 which is disposed on a cylindrical surface. The strip 21 is made of, for example copper foil having a thickness of approximately 10 μm (the depth below the surface of a conductor where the current flows at 75 MHz is 7.6 μm). In order to obtain a homogeneous magnetic field in the line direction (denoted by the letter X in the Figure), the saddle-shaped coil preferably has a configuration where the strip is situated, viewed in a radial cross-section of the cylindrical surface, on a circle at the points K, L, M and N. Radii connecting the points K, L, M and N to a centre of circle O are spaced an angular distance of 120° and 60° apart. Between the points P and Q of the saddle-shaped coil 13 there is connected a tuning capacitor C whose impedance is such that the resonant circuit formed by the saddle-shaped coil 13 and the capacitor C behaves substantially as an open circuit at frequencies in the vicinity of 50 Hz. Such a coil enables a high deflection frequency because the loops of the coil are connected in parallel. The capacitor C is preferably formed by strip-shaped conductors which are connected to the strip 21 at the points P and Q and which are situated a small distance apart. A resonance frequency of the resonant circuit formed by the coil 13 and the capacitors can be adjusted to 30 MHz by addition of a further capacitor which is connected parallel to the capacitor C. As a result, the occurrence of eddy currents in the envelope 2 is reduced and less electromagnetic radiation is emitted by the coil, so that the quality factor can be improved with respect to a frequency of 75 MHz.

The saddle-shaped coil 13 may be mounted on the inner side of the cylindrical support 14 surrounding the envelope 2 or on an inner or outer side of the envelope 2. Mounting on the inner side of the cylindrical support 14 offers the advantage that the saddle-shaped coil 13 and the coils of the horizontal deflection device 11 and the vertical deflection device 11' constitute, in conjunction with the cylinder 14, an integrated deflection system which can be detached from the envelope 2.

Figure 5:
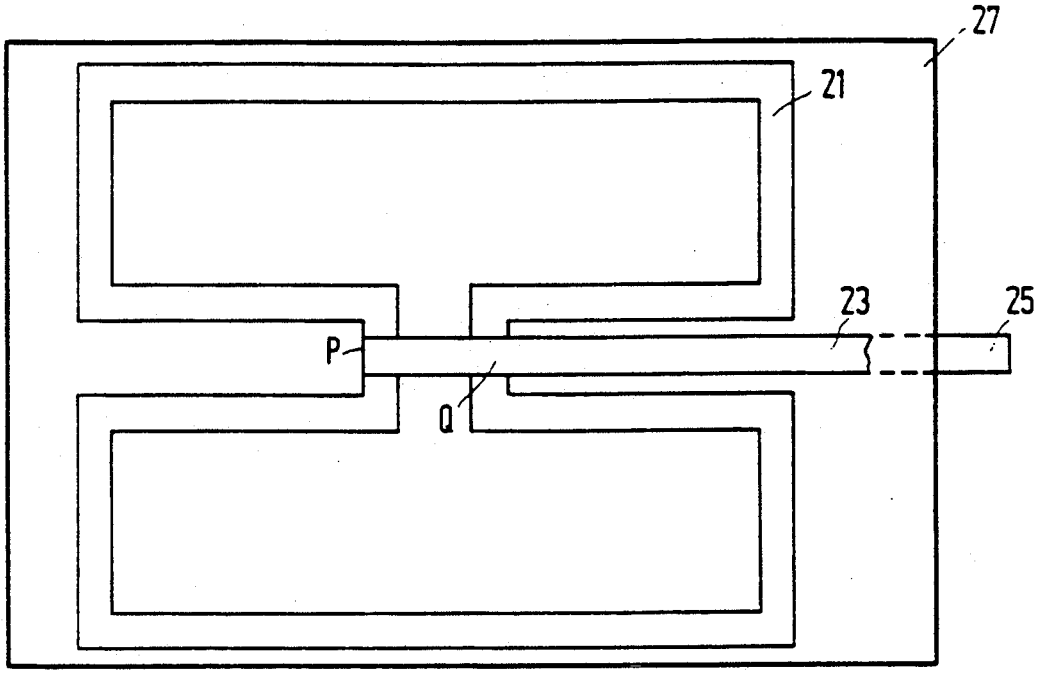
FIG. 5 shows a H-shaped loop for forming a saddle-shaped coil as shown in FIG. 4.

FIG. 5 shows the H-shaped loop used to form the saddle-shaped coil 13. The copper strip 21 is preferably mounted on a flexible substrate 27. At the points P and Q the H-shaped loop is connected to the strip-shaped conductors 23 and 25 which are situated on both sides of the substrate 27 and which together constitute a very flat capacitor; this is advantageous when the saddle-shaped coil 13 is disposed between the envelope 2 of the television pick-up tube and the deflection devices 11, 11'.

Figure 6:
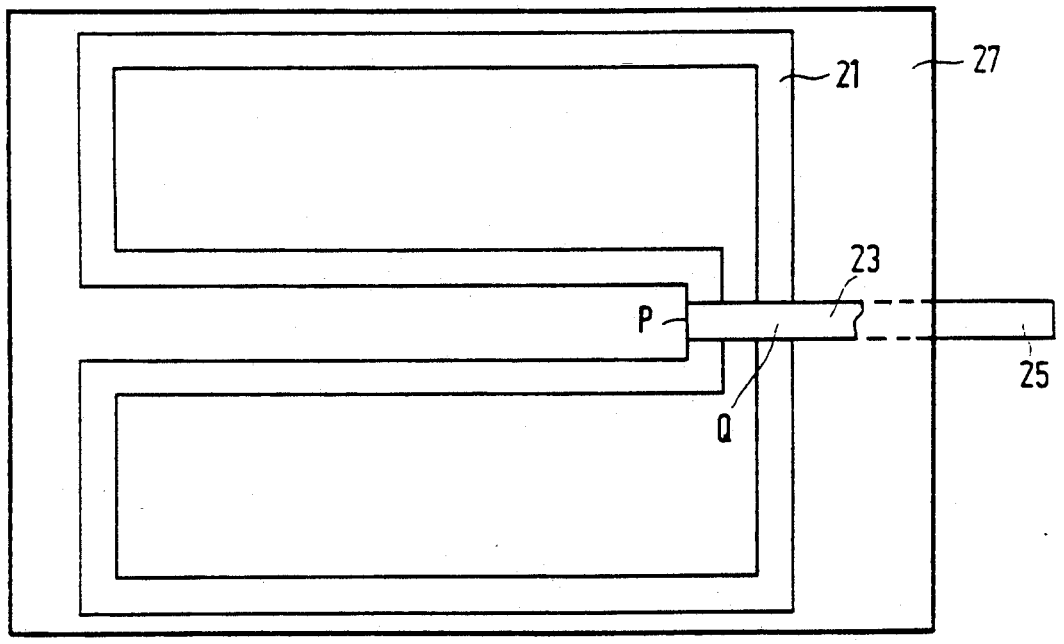
FIG. 6 shows a U-shaped loop for forming a saddle-shaped coil.

FIG. 6 shows the U-shaped loop which can be used to form the saddle-shaped coil 13.

We claim:

1. A television pick-up apparatus comprising:

a. an envelope containing an electron source for emitting an electron beam along a path to an image pick-up face;

b. a first deflection device for deflecting the electron beam across the image pick-up face along an image line;

c. a second deflection device for deflecting the electron beam in a direction transversely of the image line; and d. a third deflection device for periodically deflecting the electron beam to opposite sides of the image line during deflection of said beam along said line;

characterized in that the third deflection device comprises a saddle-shaped electrically conductive strip disposed on a surface arranged around the electron beam path, said strip forming first and second loops disposed on substantially opposite sides of said path and forming first and second portions arranged between the loops and electrically connecting said loops in parallel.

2. A deflection apparatus for attachment to a television pick-up tube comprising an envelope containing an electron source for emitting an electron beam along a path to an image pick-up face, said deflection apparatus including:

a. a first deflection device for deflecting the electron beam across the image pick-up face along an image line;

b. a second deflection device for deflecting the electron beam in a direction transversely of the image line; and c. a third deflection device for periodically deflecting the electron beam to opposite sides of the image line during deflection of said beam along said line;

characterized in that the third deflection device comprises a saddle-shaped electrically conductive strip disposed on a surface arranged around the electron beam path, said strip forming first and second loops disposed on substantially opposite sides of said path and forming first and second portions arranged between the loops and electrically connecting said loops in parallel.

3. An apparatus as in claim 1 where the third deflection device is disposed between the envelope and the first and second deflection devices.

4. An apparatus as in claim 1 or 2 where the first and second loops comprise portions extending generally in the direction of the electron beam path, said portions being angularly disposed around said path at respective angles, measured from a reference radius, of about 60°, 120°, 240° and 300°.

5. An apparatus as in claim 1 or 2 where the electrically conductive strip, when viewed in a plane, has an H-shape.

6. An apparatus as in claim 1 or 2 where the electrically conductive strip, when viewed in a plane, has a U-shape.

7. An apparatus as in claim 1 or 2 where first and second current supply conductors are electrically connected to said first and second portions, said current supply conductors being arranged relative to each other to have a mutual capacitance which, together with a self inductance of the strip, comprises a resonant circuit.

8. An apparatus as in claim 7 where the current supply conductors comprise electrically conductive strips disposed on opposite sides of said surface.

9. An apparatus as in claim 1 or 2 where the second and third deflection devices extend over substantially the same length of said electron beam path.

* * * * *